United States Patent [19]

Tharp

[11] 4,085,557

[45] Apr. 25, 1978

[54] RAISED ACCESS FLOOR SYSTEM

[75] Inventor: James A. Tharp, P.O. Box 10816, Dallas, Tex. 75207

[73] Assignee: James A. Tharp, Dallas, Tex.

[21] Appl. No.: 691,839

[22] Filed: Jun. 1, 1976

[51] Int. Cl.[2] ..... E04F 15/024

[52] U.S. Cl. ..... 52/263; 52/126; 52/620; 52/622

[58] Field of Search ..... 52/620, 619, 126, 122, 52/622, 263; 428/92, 97

[56] References Cited

U.S. PATENT DOCUMENTS

| | | | |
|---|---|---|---|
| 3,236,018 | 2/1966 | Graham et al. | 52/619 |
| 3,396,501 | 8/1968 | Tate | 52/619 X |
| 3,425,179 | 2/1969 | Haroldson | 52/126 X |
| 3,470,663 | 10/1969 | Tate | 52/126 |
| 3,548,559 | 12/1970 | Levine | 52/619 |
| 3,582,445 | 6/1971 | Okuhashi | 428/97 |
| 3,616,584 | 11/1971 | Sartori et al. | 52/126 |
| 3,669,454 | 6/1972 | Kolonel | 428/85 |
| 3,778,331 | 12/1973 | Scharf | 428/97 |
| 3,811,237 | 5/1974 | Bettinger | 52/126 |

FOREIGN PATENT DOCUMENTS

| | | | |
|---|---|---|---|
| 2,333,005 | 7/1974 | Germany | 52/126 |

OTHER PUBLICATIONS

Multi-a-Floor Sweet's Catalog, 1966 11k-Mu, 4 pp.
Liskey Sweet's Catalog, 1974 10.27/Li, p. 9.
NL Floating Floor, Sweet's Catalog, 1974 10.27/Fl, p. 3.
Weber, Sweet's Catalog, 1966 11k/Wb, pp. 5 and 6.
Westinghouse Raised Floor System Sweet's Catalog, 1966 11k/We, 4 pp.
Elaflor Sweet's Catalog, 1966 11k/Li, pp. 1-6.

*Primary Examiner*—Leslie Braun

[57] ABSTRACT

A floor panel designed particularly for computer room raised access floors, the floor panel including a pan containing a relatively thick chip board core material, a PVC impact molding fitted between the edges of the chip board core material and the inner side of the pan, the PVC impact molding resting upon the upper edges thereof, the PVC impact molding framing a top galvanized steel sheet on top of which a carpet is fitted.

3 Claims, 5 Drawing Figures

Fig. 1
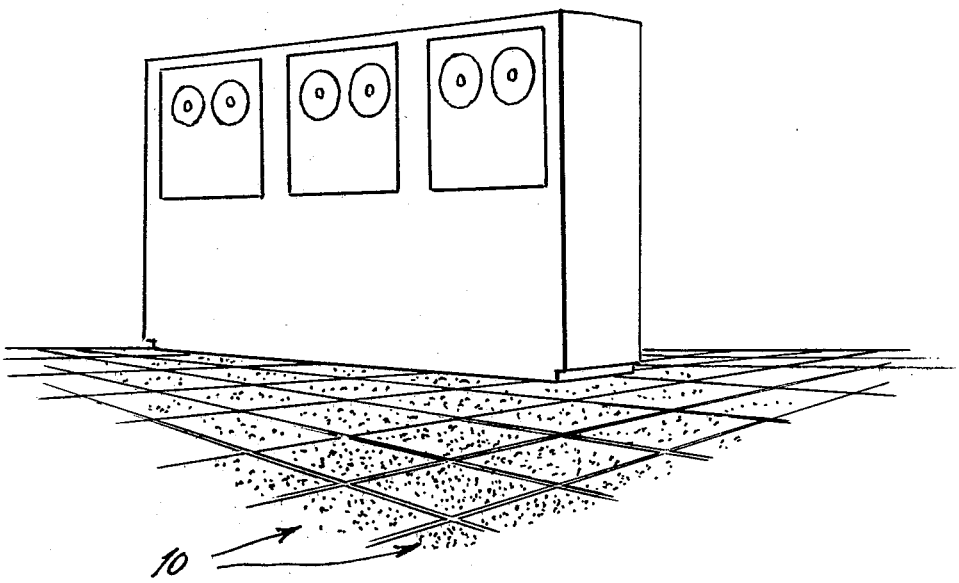
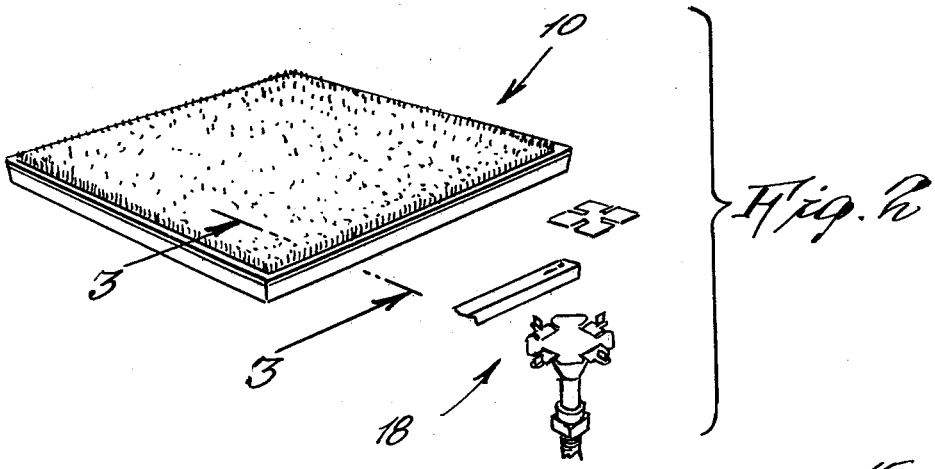
Fig. 2
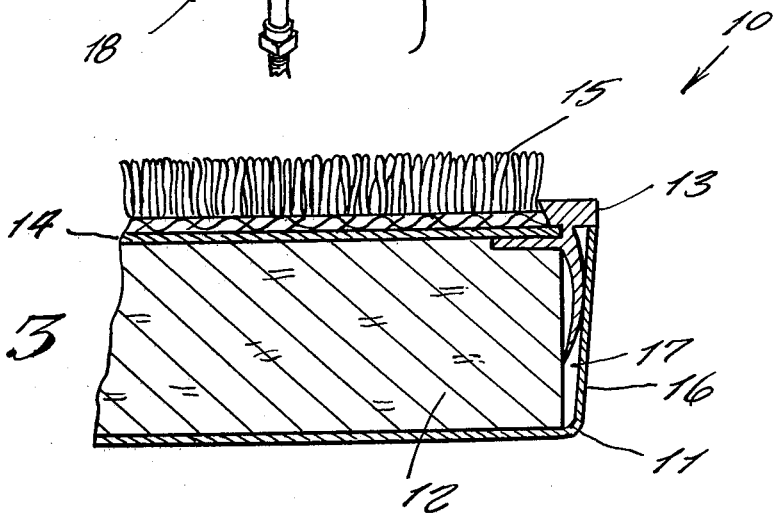
Fig. 3

RAISED ACCESS FLOOR SYSTEM

This invention relates generally to floor panels.

A principal object of the present invention is to provide a raised access floor system, designed particularly for computer room raised floors.

Another object of the present invention is to provide a raised access floor system, a steel clad high density chip board core panel designed to support heavy loads that are characteristic of computer room areas, and wherein the panels can be easily removable and replaceable by means of a carpet or vacuum lifting device.

Another object is to provide a raised access floor system that includes a PVC molding that frames a carpet and protects the carpet edge from raveling.

Another object is to provide a raised access floor system, having the novelty over other existing systems by using a same substructure components to serve three different market needs.

More specifically, another object is to provide a raised access floor system, in which a pedestal is designed to be used in (1) pedestal only panel support, (2) drop in grid type for increased lateral stability, and (3) rigid grid type for greater all-directional stability, in seismic areas, and the like; in this type, their channels being mechanically fastened to the pedestal heads.

Yet another object is to provide a raised access floor system, which (a) permits customers to change the system to meet changing requirements, i.e., they can go from a pedestal only support, to lift out full grid type, to a rigid grid type, and still utilize all existing components, (b) simplifies inventory for distributors, thus lowering the cost, and (c) lowers freight and installation costs, because fewer parts are required in inventory and/or installation.

Still another object is to provide a raised access floor system, which offers convertibility, so that if a customer makes a change, he can change the substructure, and still utilize the existing parts.

Still a further object is to provide a raised access floor system, which is lighter in weight than other known systems, and wherein the system goes in much faster; the rigid grid system being designed to be used with a clutch type hand-held power tool, which makes installation low cost.

Other objects are to provide a raised access floor system, which is simple in design, inexpensive to manufacture, rugged in construction, easy to use and efficient in operation.

FIG. 1 is a perspective view of a computer room raised floor system shown incorporating the present invention;

FIG. 2 is a perspective view of one of the raised access floor panels of the system in relation to its supporting structure;

FIG. 3 is an enlarged cross-sectional view taken on line 3—3 of FIG. 2;

Figure 4:
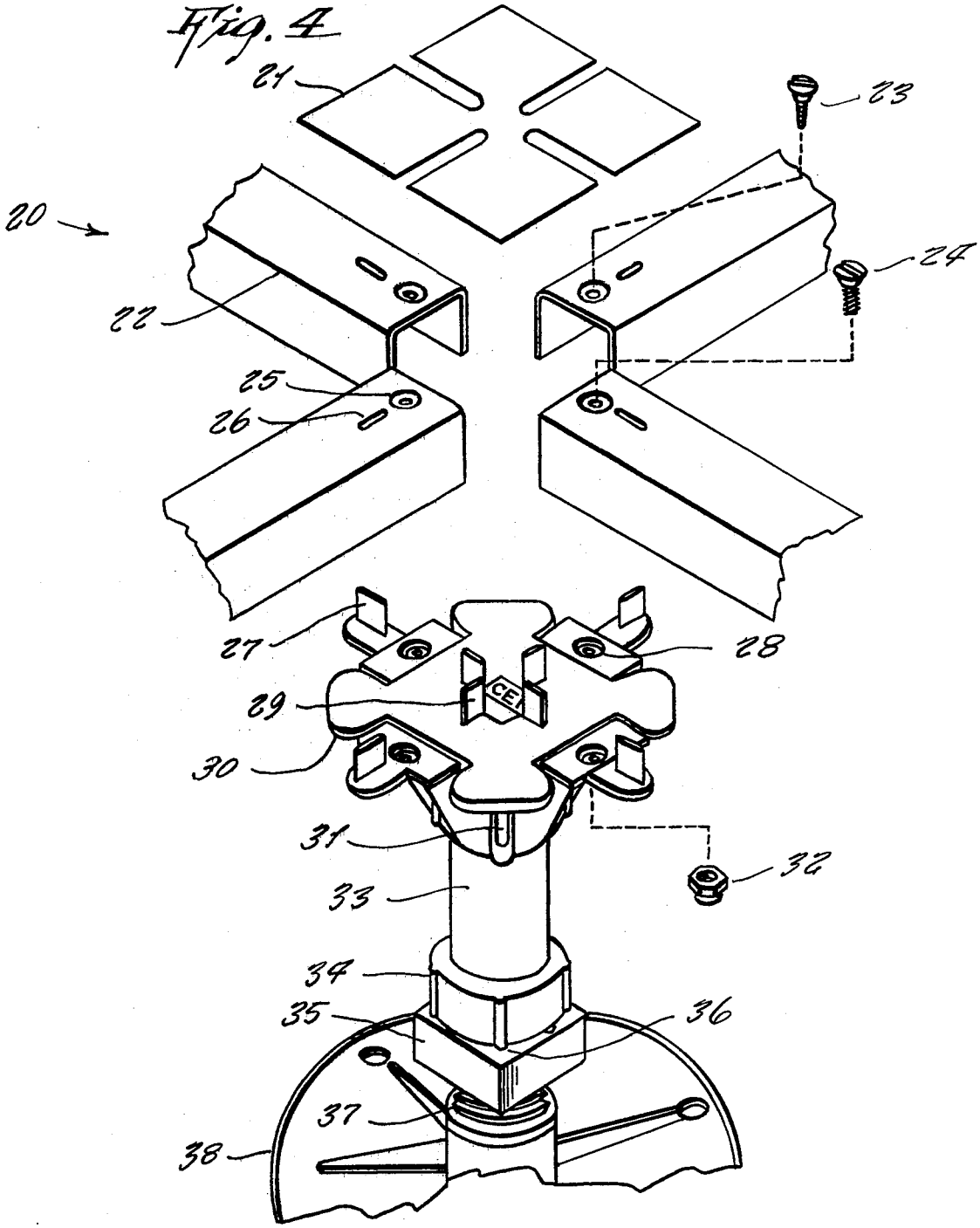
FIG. 4 is an exploded perspective view of the pedestal and the substructure system.

Referring now to the drawing in greater detail, reference numeral 10 represents a raised access floor system according to the present invention, wherein there is a pan 11 formed from a galvanized steel sheet, but is blanked and notched. A high density chip board core material 12, having a density of 44 to 47 pounds per cubic foot, is cut to size so as to fit inside the pan. A PVC impact molding 13, having a cross-sectional shape as shown in FIG. 3, is fitted between the outer side of the chip board core material and the inner side of the pan, the PVC impact molding resting upon the upper edge of the pan and upon the upper edge of the chip board core material. A galvanized steel sheet 14, is framed by the PVC impact molding, and on top of the steel sheet there is fitted a carpet 15, having tufted loop pile with a minimum of 64 tufts per square inch, and having a flame spread rating A (STM-E-84) 75 or less.

As clearly shown in FIG. 3, the side wall 16 of the pan is upwardly slightly flared, so as to form a space 17 therebetween, and the sides of the chip board core material, which is widest at its upper end, and into which the PVC impact molding is inserted.

The PVC molding is notched in at the inside bottom edge, to receive the cut carpet and protect it against edge raveling. The PVC molding will protect the brittle edge of an HPL covering material against chipping, if such material is used instead of a carpeting, and when panels impact during removal, handling or reinsertion. The PVC molding is extended and formed into a bow at the bottom to offer backup support against indentation of the upturned metal edge of the panel during removal, handling or reinsertion. The PVC molding will be extended laterally in the direction of the panel center, about ¼ of an inch, so that it will effect a positive lock under the edge of the top galvanized steel sheet 14, in such a way that it cannot accidentally pop out during periods of rough handling.

As clearly shown in FIG. 3, the PVC impact molding includes a downwardly tapered fin that bows outwardly so to abut at its center with the pan, and abut at its lower edge with the core material.

The above proposed design will eliminate the problem of surface moisture, such as occurs from mopping, or the like, from seeping past the inside edge of the PVC molding, so as to cause swelling of the core material.

As shown in FIG. 2, the raised access floor panel 10 is supported upon a grid pedestal, and its associate parts, as shown at 18. The panel is supported under one square inch of each corner by the pedestal, which is of aluminum, and which is adjustable.

It should be noted that the raised access floor system will accommodate a variety of covering materials, i.e., high pressure laminate, pure homogeneous vinyl, vinyl asbestos, carpet or other suitable materials.

It is to be further noted that the raised access floor system includes a substructure that is an integral part thereof.

There are three different types of supporting structure, comprising namely (a) pedestal only, (b) lift-out grid, and (c) rigid grid-mechanically fastened to the pedestal heads.

Reference is now made to FIG. 4 of the drawing.

The access panel substructure 20 includes a Poly Vinyl Chloride pad 21 to prevent metal to metal contact i.e. sound deadening pad. PVC contains carbon so that it is also a grounding pad which facilitates continuity of ground.

Figure 5:
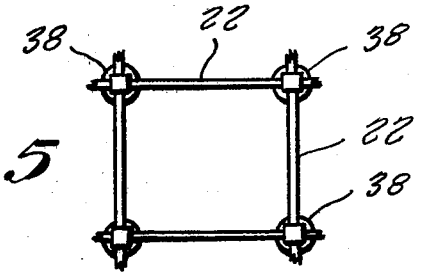
FIG. 5 is a top plan view of the access panel substructure shown assembled and fragmentary.

A galvanized steel channel 22 is provided to facilitate continuity of ground throughout the substructure and lend lateral stability to the substructure by intermembering with the pedestal heads in such a way that all pedestals are mechanically interconnected by means of a drop in grid system. A 24 inch center to center grid system together with adjustable pedestals forms the substructure as shown in FIG. 5.

A flat head self tapping plated steel screw 23 may be used in order to mechanically fasten the grid sections to the pedestals, thus forming a rigid grid substructure.

As an alternate to screw 23, a threaded bolt 24 together with a nut 32 may be utilized to assure sufficient rigidity for applications in seismic areas. In this application the grid is bolted to the pedestal, so that a bolted, rigid grid framework supports the access floor panels.

The channel stringer is punched and dimpled, as shown at 25, with the forming die to accept a flat head screw 23.

A slot 26 is punched in the above punching and dimpling operation 25, and serves to drop over the aluminum lug.

The aluminum lug 27 is part of the casting of the pedestal head to facilitate the drop in grid system. Pedestals are thus interconnected for lateral stability, but permit infinite accessibility to the subfloor area. Grids may be lifted out to create a working trench, and dropped back into intermembering position. This method is an alternate to those described with screw 23 and at 24, mentioned above.

A die formed recess 28 in the platform offers a receiving well for the numbers 23, 24 and 25 described above. This platform is dropped below the plane of the pedestal head surface, to match the thickness of metal in the channel stringer 25.

A vertical lug 29 is provided to maintain panel alignment in conjunction with the aluminum lug 27.

Pedestal head platform 30 is provided, which supports a one square inch corner area of each panel. One injection molded pedestal may be used to accomplish a "pedestal only" substructure, with the deletion of numbers 22, 23 and/or 24, described above.

Strut webbing 31 is provided to support platform described at 30. The hex head fiber lock nut 32 is provided to complete the bolted assembly of the bolt 24.

A hard drawn one inch OD extruded aluminum tubing 33 has a minimum of 0.058 inch wall thickness. The tubing is cut to proper length that determines the finished height of the raised floor.

A collar 34 is designed to interlock with a nut 35 to prevent accidental readjustment.

Square aluminum nut 35 provides level adjustments and interlocks with collar 14 to prevent accidental readjustment as stated.

Eight different interlocking positions 36 are indicated around one 360° turn.

A threaded injection molded aluminum stud 37 allows nut to travel vertically 3 inches for the purpose of leveling the finished floor. This latitude in vertical adjustment accommodates varying jobsite conditions.

An aluminum injection molded base 38 is formed to receive tapered shank or stud. Base covers 16 square inches and may be driven to the building floor with ram set nails or adhered to the floor with a mastic adhesive.

Thus there is provided a raised access floor panel, having numerous advantages.

While various changes may be made in the detail construction, it is understood that such changes will be within the spirit and scope of the present invention as is defined by the appended claims.

What I now claim is:

1. A raised access floor system, comprising, in combination, a pan of galvanized steel, a high density chip board core material placed inside said pan, the sides of both said pan and said core material both flaring upwardly outward with said pan flaring greater than said core material, thus forming an upwardly flaring space therebetween, a PVC impact molding resting upon an upper edge of said pan and upon an upper edge of said core material, said PVC impact molding forming a frame around a central opening, an inner edge of said molding including an inwardly extending flange and an angularly inclined side wall to form an acute corner, a galvanized steel sheet in said central opening resting on said flange, and a carpet placed upon said galvanized sheet, the edges of said carpet extending into said acute corner along said inner edge of said PVC impact molding, and a downward extending fin integral with an underside of said PVC impact molding extending into said space between said pan and the sides of said core material, said fin being downwardly tapered in thickness and outwardly bowed, so a mid-portion thereof abuts with said pan side while a lower edge thereof abuts with said core material, said core material having a density between 44 and 47 pounds per cubic foot, and said raised access floor panel including a substructure for support thereof elevated above a building floor.

2. The combination as set forth in claim 1, wherein said carpet has a tufted loop pile with a minimum of 64 tufts per square inch and having a flame spread rating of A (STM-84) 75 or less; said carpet including approximately one percent in static reduction fibre.

3. The combination as set forth in claim 2, wherein three different types of supporting structure are incorporated and comprise a pedestal only, a lift-out grid and a rigid grid-mechanically fastened to the pedestal heads.

* * * * *